United States Patent [19]

Swanson et al.

[11] Patent Number: 5,021,714

[45] Date of Patent: Jun. 4, 1991

[54] CIRCUIT FOR STARTING AND OPERATING FLUORESCENT LAMPS

[75] Inventors: Dail L. Swanson; Shannon Edwards, both of Danville, Ill.

[73] Assignee: Valmont Industries, Inc., Valley, Nebr.

[21] Appl. No.: 521,377

[22] Filed: May 10, 1990

[51] Int. Cl.[5] ..... H05B 41/14; H05B 41/36

[52] U.S. Cl. ..... 315/101; 315/244; 315/DIG. 5; 315/105; 315/106

[58] Field of Search ..... 315/101, 239, 242, 243, 315/244, 276, 283, 105, 106, DIG. 2, DIG. 5

[56] References Cited

U.S. PATENT DOCUMENTS

| | | | |
|---|---|---|---|
| 2,330,312 | 9/1943 | Raney | 176/124 |
| 2,354,421 | 7/1944 | Pennybacker et al. | 315/73 |
| 2,462,335 | 2/1949 | Reinhardt | 315/100 |
| 3,084,283 | 4/1963 | Grunwaldt | 315/205 |
| 3,418,527 | 12/1968 | Miller | 315/244 |
| 3,555,352 | 1/1971 | Michalski | 315/244 X |
| 3,611,021 | 10/1971 | Wallace | 315/307 |
| 3,866,088 | 2/1975 | Kaneda et al. | 315/DIG. 5 X |
| 4,009,412 | 2/1977 | Latassa | 315/119 |
| 4,010,399 | 3/1977 | Bessone et al. | 315/97 |
| 4,053,813 | 10/1977 | Kornrumpf et al. | 315/206 |
| 4,097,779 | 6/1978 | Latassa | 315/106 |
| 4,145,638 | 3/1979 | Kaneda | 315/244 X |
| 4,146,820 | 3/1979 | Bessone et al. | 315/227 |
| 4,158,793 | 6/1979 | Lewis | 315/101 |
| 4,185,233 | 1/1980 | Riesland et al. | 315/276 |
| 4,207,497 | 6/1980 | Capewell et al. | 315/96 |
| 4,399,391 | 8/1983 | Hammer et al. | 315/244 |
| 4,900,986 | 2/1990 | Hammer et al. | 315/101 |

*Primary Examiner*—Eugene R. LaRoche
*Assistant Examiner*—Ali Neyzari
*Attorney, Agent, or Firm*—Zarley, McKee, Thomte, Voorhees & Sease

[57] ABSTRACT

A circuit for starting and operating fluorescent lamps from an a-c low frequency power source includes a reactive ballast means connected to ballast the lamps and having a non-linear characteristic for producing a plurality of harmonics of the power source frequency, and a capacitor and a cathode heating transformer connected in series and connected to receive power from said ballast means and resonant in a frequency range encompassing a plurality of said harmonics. This resonant voltage is applied across the lamps to aid the starting of their discharge and thereafter the lamps operate at the a-c power source frequency. The aforesaid resonance frequency range preferably is broad enough to encompass several harmonics of the power source frequency, for example the third through the ninth harmonics (180 to 540 Hz for a source frequency of 80 Hz). Preferably a switch is connected in series with the capacitor and cathode heating transformer for opening the cathode heating circuit when the lamps are operating. This switch may be a bidirectional diode or equivalent voltage sensitive solid state switch, which switches on and off during each half cycle of the lamp starting time period and thus contributes to the harmonic content of the starting voltage waveform.

4 Claims, 3 Drawing Sheets

CIRCUIT FOR STARTING AND OPERATING FLUORESCENT LAMPS

BACKGROUND OF THE INVENTION

This invention is in the field of circuits for starting and operating fluorescent lamps from low frequency a-c power. In particular, this invention is an improvement over that invention described in the U.S. Pat. No. 4,399,391.

Various circuits have been devised for starting and operating fluorescent lamps, and for heating or preheating their cathodes. U.S. Pat. No. 4,185,233 to Riesland, Hammer and Lemmers discloses a circuit in which cathodes of fluorescent lamps are heated by a transformer, and U.S. Pat. No. 4,207,497 to Capewell et al. discloses a high frequency lamp operating circuit in which the cathodes are heated by a transformer having a primary winding connected in series with a capacitor to the a-c power source, the primary winding and/or ballast inductor in combination with the capacitor, being resonant at or near the frequency of the a-c power source; the transformer is connected to provide constant cathode voltages during the high frequency lamp operation and dimming. U.S. Pat. No. 3,611,021 to Wallace and U.S. Pat. No. 4,207,497 to Capewell also disclose high-frequency circuits for starting and operating fluorescent lamps, and employ a resonant circuit tuned to a single individual harmonic of the high-frequency (20 kilohertz) operating current source to aid in starting the lamps.

Other fluorescent lamp circuits have been devised which turn off the cathode heating power while the lamps are operating. For example, U.S. Pat. Nos. 2,330,312 to Raney, 4,009,412 to Latassa, and 4,146,820 to Bessone disclose circuits having magnetically operated switches which open to disconnect the cathode heating circuit when the lamps are operating; U.S. Pat. Nos. 2,354,421 to Pennybacker, 2,462,335 to Reinhardt, and 4,097,779 to Latassa disclose thermostatic cathode heating disconnect switches; and U.S. Pat. No. 4,010,399 to Bessone discloses solid state switches for the same purpose.

In some cases, the primary coil is subject to undesirable high temperatures if one or both of the lamps should rectify the high temperature sometimes causing damage to the coil and ballast.

In the circuit of U.S. Pat. No. 4,399,391, a single switch 21 is utilized which is preferably a voltage actuated bidirectional diode such as SIDAC. Although the utilization of a single SIDAC in the circuit of the '391 patent did result in satisfactorily operating the circuit, it has been found that it is preferable to stack a plurality of the SIDACS in series.

SUMMARY OF THE INVENTION

Objects of the invention are to provide improved and low-cost circuits for starting and operating fluorescent lamps from a low frequency (such as 60 Hz) power source, and to conserve electrical energy.

The invention comprises, briefly and in a preferred embodiment, circuits for starting and operating fluorescent lamps from an a-c low frequency power source. The circuit comprising reactive ballast means connected to ballast the lamps and having a non-linear characteristic for producing a plurality of harmonics of the power source frequency, and a capacitor and a cathode heating transformer connected in series and connected to receive power from said ballast means and resonant in a frequency range encompassing a plurality of said harmonics. This resonant voltage is applied across the lamps to aid the starting of their discharge and thereafter the lamps operate at the a-c power source frequency. Thus, the lamps are started with the aid of a peaked higher voltage waveform (lag circuit) or a harmonically enriched non-linear waveform (lead circuit) than is normally present in their operating frequency. The aforesaid resonance frequency range preferably is broad enough to encompass several harmonics of the power source frequency, for example the third through the ninth harmonics (180 to 540 Hz for a source frequency of 80 Hz). Preferably a switch is connected in series with the capacitor and cathode heating transformer for opening the cathode heating circuit when the lamps are operating. This switch may be a bidirectional diode such as a SIDAC, triac-diac combination, or equivalent voltage sensitive solid state switch, which switches on and off during each half cycle of the lamp starting time period and thus contributes to the harmonic content of the starting voltage waveform.

DESCRIPTION OF THE PREFERRED EMBODIMENTS

Figure 1:
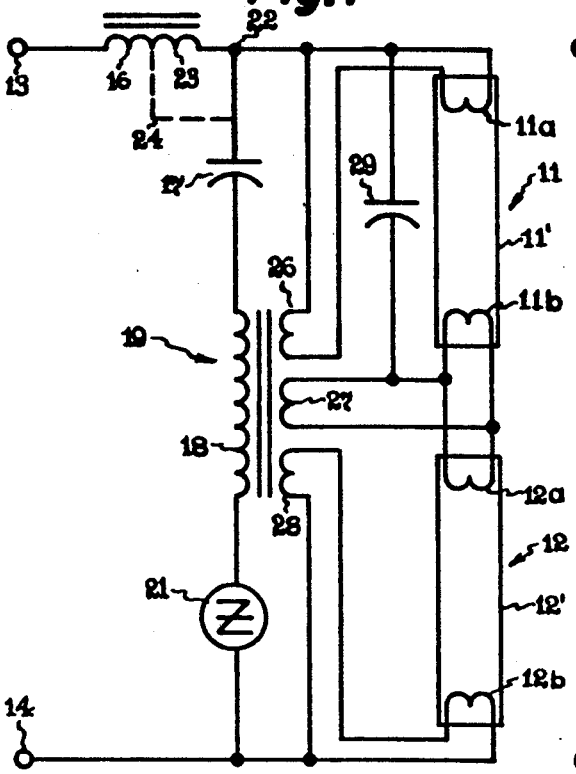
FIGS. 1–7 are reproductions of the drawings of U.S. Pat. No. 4,399,391.

In FIG. 1, a pair of fluorescent lamps 11 and 12 are connected electrically in series and to the output of a circuit having input terminals 13 and 14 for connection to a source of low-frequency a-c electrical power, for example 120, 240, or 277 volts, at a given frequency of for example 80 Hz. The lamps 11 and 12 respectively comprise envelopes 11' and 12' of glass or other suitable material containing electron emissive cathodes **11*a*, 11*b* and 12*a*, 12*b*, respectively near the ends thereof. These cathodes may comprise coiled tungsten wire filaments coated with an electron emissive material. The lamp envelopes contain mercury and an inert fill gas such as argon. krypton. neon, or mixtures thereof. The cathodes 11*b* and 12*a* are connected electrically in parallel, thus connecting the lamps 11 and 12 in electrical series. An inductive ballast reactor 18 is connected between the power input terminal 13 and an end the cathode 11*a*, and the power input terminal 14 is connected to an end the cathode 12*b*. A series connected combination of a capacitor 17, a primary winding 18 of a cathode heating transformer 19, and switch 21 is connected between the power input terminal 14 and a point 22 at the lamp end of the ballast reactor 16. Alternatively, the latter connection can be to a tap 23 on the ballast 16 as indicated by dashed line 24. The, cathode heating transformer 19 comprises a first secondary winding 26 connected across the cathode 11*a*, a second cathode heating winding 27 connected across the parallel cathode 11*b* and 12*a*, and a third secondary winding 28 connected across the cathode 12*b*. A starting capacitor 29 is connected across the lamp 11 in conventional manner, through which electrical energy passes to aid in starting the electrical discharge in lamp 12, whereupon the lamp 11** readily starts.

Figure 7:
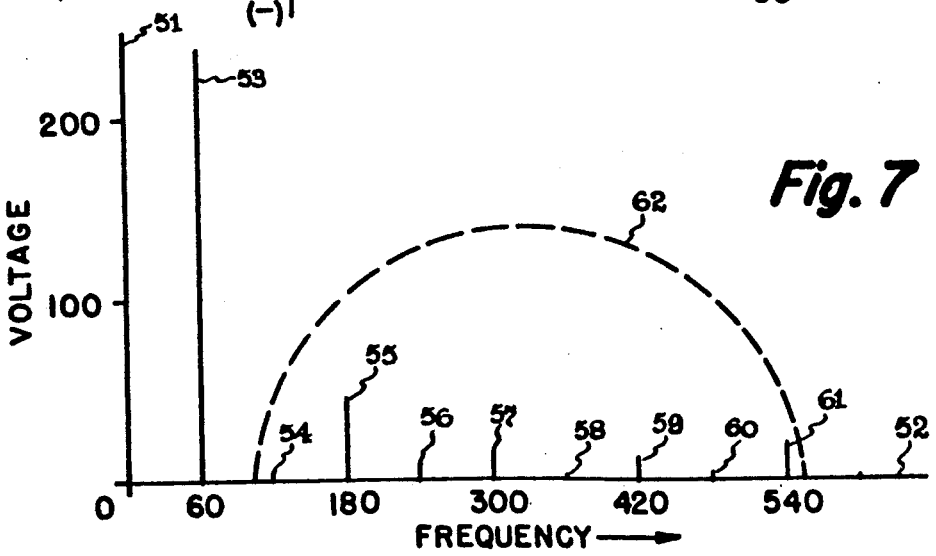

The ballast reactor 16 is designed so as to be non-linear due to partial magnetic saturation when current flows through it, thereby generating harmonics of the frequency of the input power to terminals 13 and 14, for example discernible harmonic frequencies up to or beyond the 10th harmonic of the input power frequency and of varying amplitudes, for example as shown in FIG. 7.

In accordance with the invention, the reactance values of the inductors 16 and 18, and of the capacitor 17 are chosen so these components are broadly tuned to be resonant over a frequency range which encompasses two or more of the aforesaid harmonic frequencies. They may be broadly tuned so as to encompass several harmonics such as the second through ninth harmonics. This is illustrated in FIG. 7, in which the vertical axis 51 represents amplitude and the horizontal axis 52 represents frequency. In measurements made on the circuit of FIG. 5, the 60 Hz input RMS voltage 53 at terminals 13, 14 was 120; of the several RMS harmonic voltages shown, measured across switch 21 and inductor 18, the second harmonic 54 was 0.1 volt, the third harmonic 55 was 41 volts, the fourth 56 was 0.5 volt, the fifth 57 was 9.4 volts, the sixth 58 was 0.5 volt, the seventh 59 was 4.7 volts, the eighth 80 was 1.0 volt, and the ninth 81 was 10 volts. The dashed curve 62 is an idealized representation of the resonance curve of capacitor 17*a* and inductors 18, 42 which in this example is sufficiently broad to encompass the second through ninth harmonics 54 to 61. As is well known, in a capacitor-inductor series resonant circuit, the voltage produced across each of the capacitive and inductive components of the circuit is considerably greater than the total voltage applied across the resonant circuit, and these voltages are substantially out of phase with respect to each other. Although theoretically the greatest peak value of starting voltage for the lamps 11, 12 could be obtained across the capacitor 17 only, it has been found that enhanced peaked starting voltage can be obtained across various parts of the tuned resonant circuit. For example, in a ballasting circuit built according to FIG. 1, with the starting voltage for the lamps 11, 12 taken from between the points 14 and 22 of the circuit and with the resonant circuit 17, 18 inoperative, the peak value of starting voltage was approximately 350 volts when the input voltage at terminals 13 and 14 was 240 RMS volts at 60 Hz; and with the resonant circuit comprising components 16, 17, and 18 operative in the harmonic 30 frequency spectrum, the harmonically induced resonant peak voltage was about 420 volts which substantially improved lamp starting. The voltage curves in FIG. 6 have been traced from photographs of an oscilloscope display and show starting voltage 31 (solid curve) and lamp operating voltage 32 (dashed line). The peak values 33 of the starting voltage 31, which occur during each half-cycle of the 60 Hz power input frequency, in this example, has a value of about 420 peak volts for a power supply input voltage of 240 RMS volts at input terminals 13, 14, this peak value 33 being considerably higher than the peak voltage without the resonant effect and being produced due to the resonant circuits 16, 17, and 18 being tuned to some harmonic or harmonics of the power input frequency. After the lamps 11, 12 start and are operating, the operating voltage 32 has a peak value of 200 volts at the peaks 34 thereof, and has 175 volts RMS value. In starting the lamps, the peak 33 voltage value of the starting voltage 31 is an important criteria, whereas in operating the lamps the RMS value of the operating voltage 32 is the more important criteria. Starting of the lamps 11, 12 is facilitated by the increased starting voltage value due to the enhanced magnitude of the peaks 33 produced by the resonant starting circuit, but also because the lamps start more easily, as the harmonic frequency content of the starting voltage waveform is increased. The peaks 33 of the starting voltage 31, which contain harmonic frequency components of the power input frequency, and which are superimposed on the 60 Hz frequency, are in effect such a higher frequency, and thus enhance lamp starting in addition to their being an increased voltage value with respect to the power input voltage of the circuit. Thus improving the starting of the lamps 11, 12, it is found feasible in some instances to eliminate the conventional starting stripes in the lamps, thus reducing the cost thereof. As is well known, the starting of the lamps is effected not only by the peak voltage applied thereacross, but also by electrostatic or electromagnetic coupling of the starting voltage between the outer ends of the lamp combination, (i.e., the ends at cathodes 11*a* and 12*b*) and the metal or otherwise electrically conductive light fixture in which the lamps are mounted.

Contrary to the above-referenced Wallace and Kornrumpf patents, which teach the use of a high-frequency square-wave inverter (producing square waves at a high frequency of 20 kilohertz, for example, and inherently having high values of harmonic amplitude content), and a tuned circuit resonant at a single harmonic frequency for aiding the, starting of fluorescent lamps, the present invention is based on the unexpected discovery that fluorescent lamp starting can be aided in a low frequency (60 hertz, for example) sine-wave powered circuit with simultaneously generated cathode voltage by producing harmonics of the sine wave, by means of a non-linear ballast inductor (which harmonics have considerably lower amplitude than the harmonics contained in square waves of the prior art), and providing a tuned circuit that is resonant over a relatively broad frequency band which includes, and encompasses, several of the harmonics thereby providing a sufficiently harmonically enriched starting voltage which can aid the starting of the lamps.

Further in accordance with the invention, the switch 21, which is a closed switch during starting of the lamps, opens the circuit to the primary winding 18 after the lamps 11, 12 have started and while they are operating, thereby turning off the cathode, heating power source and conserving this electrical power while the lamps are operating. The cathode heating current is not required while the lamps are operating, because during operation electrons are emitted, from a small area on each of the cathodes, which are called "hot spots", and which remain hot enough during operation to sustain the required ability of the cathodes to emit the electrons to support the electrical gas discharge in the lamps. The switch 21 may be of any suitable type such as voltage actuated, current actuated, or thermally actuated from heat of the lamps 11 or 12. The preferred switch 21, as shown, is a voltage actuated bidirectional diode such as a SIDAC. Such a device is disclosed in U.S. Pat. No. 3,866,088 to Kaneda, which is incorporated herein by reference thereto. This type of switch is conductive when a voltage thereacross is above a certain value, and is open or non-conductive when the voltage thereacross is below a given value. For example, the switch 21 becomes conductive when the voltage thereacross is relatively high, such as when the power input voltage from terminals 13, 14 is applied thereto during starting of the lamps 11, 12, and the switch becomes open and non-conductive when the voltage applied thereto is relatively below this value, due to the lamps 11, 12 operating and conducting current which causes a voltage drop across the lamps 11 and 12, which thus reduces the voltage applied across the switch 21. When this voltage-actuated switch is conductive during lamp starting, in reality it turns on and off during each half-cycle of the 60 Hz voltage, which advantageously adds harmonic frequency content into the resonant circuit. Such a switch also increases lamp life by reducing cathode sputter damage during starting as compared to a flow switch type start.

Figure 2:
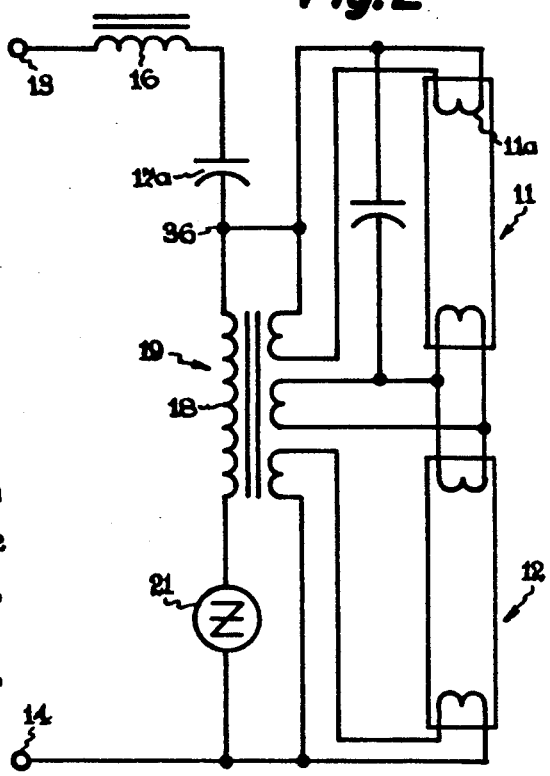
Figure 3:
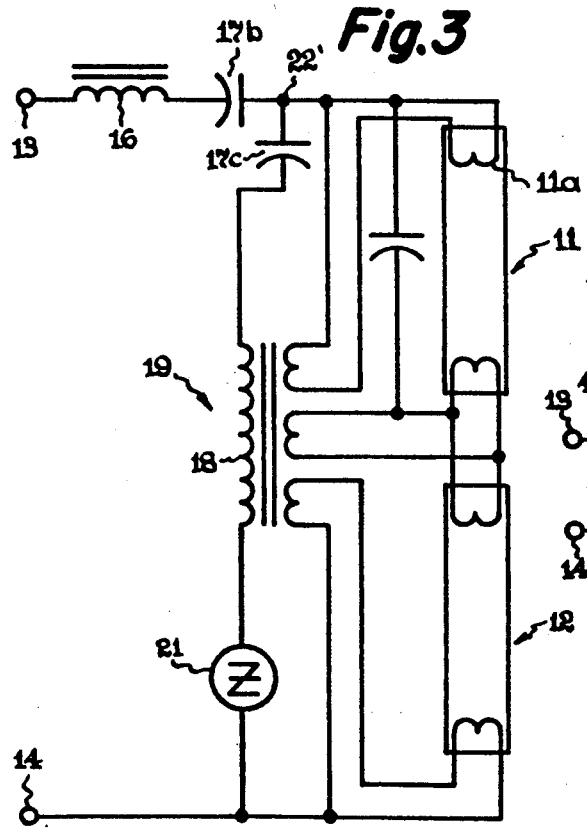

The circuit of FIG. 2, the commonly referred to as a "lead" circuit, is similar to that of FIG. 1, except that the starting voltage is obtained across only the primary winding 18 of the cathode heating transformer 19 which is achieved by connecting the cathode 11*a* to the junction 36 of the capacitor 17 and primary winding 18. The circuit has improved starting characteristics similar to that described for the circuit of FIG. 1 and the capacitor 17 of FIG. 1 is designated 17*a* in FIG. 2 because, in addition to functioning in the resonant starting circuit, it also functions as a power capacitor during operation of the lamps 11, 12 in well known manner. The circuit of FIG. 3 is a "lead" circuit similar to that of FIG. 2 except that the dual functions of capacitor 17*a* in FIG. 2 are performed by individual capacitors 17*b* and 17*c* in FIG. 3. Capacitor 17*b* is the power capacitor, connected between the ballast 16 and cathode 11*a* in normal manner, and capacitor 17*c* is connected to the junction 22' of capacitor 17*b* and cathode 11*a* and functions like capacitor 17 in FIG. 1. Capacitor 17*c* has a considerably lower value of capacitance than does 17*b*, and therefore, a considerably higher peak value of resonant voltage is produced across it than across power capacitor 17*b*, to aid in starting the lamps.

Figure 4:
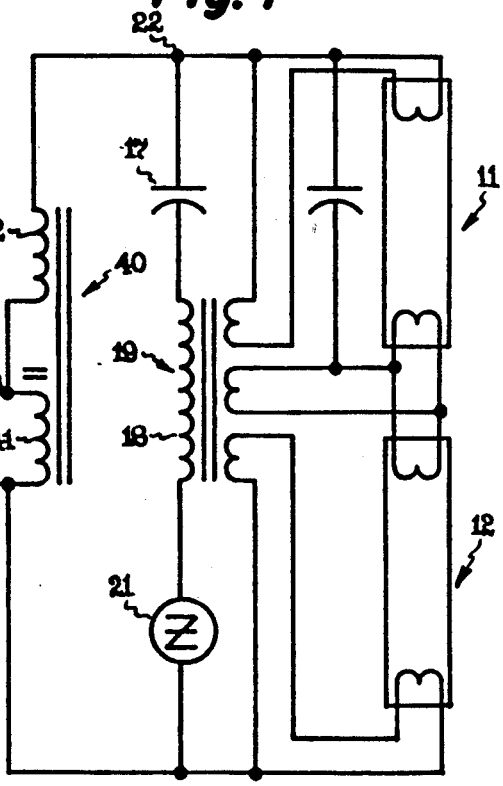
Figure 5:
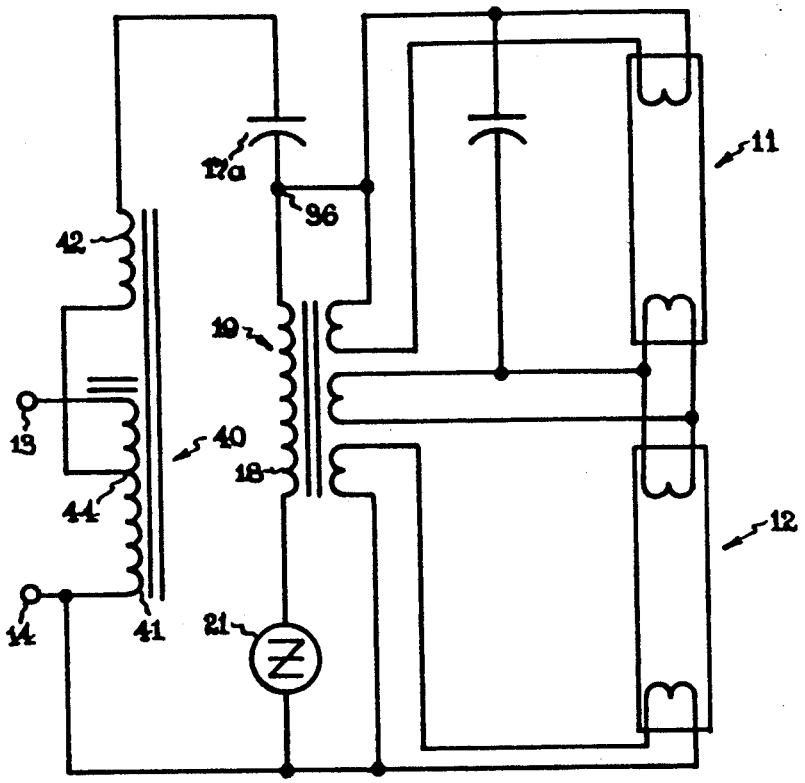
Figure 6:
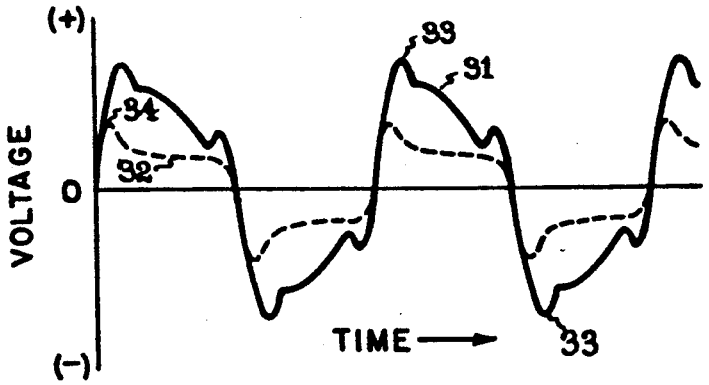

In the circuits shown in the drawing, the positions of the resonant circuit capacitor 17 or 17*c* and primary winding 18 can be interchanged and the lamps 11, 12 can be connected to obtain the harmonically peaked starting voltage from across the capacitor 17. Also, the switch 21 can be moved to other positions in the series circuit 11, 18. The circuits of FIGS. 4 and 5 are generally similar too, and function the same as, the circuits of FIGS. 1 and 2. respectively, except that in FIGS. 4 and 5 the ballast reactor is in the form of an auto transformer. The auto transformer comprises a primary winding 41 connected across the input terminals 13, 14, and a secondary winding 42 magnetically coupled to the primary 41 and having one end thereof connected to an end 43 of the primary winding 41, or to a tap 44 on the primary winding 41, as is disclosed in the above referenced patent to Riesland et al., which is incorporated here and by reference thereto. The auto transformer 4D has a turns ratio of secondary 42 to primary 41 so as to increase the voltage with respect to the input voltage terminals 13, 14. The secondary winding 42 also functions as the reactive ballast for operating the lamps 11, 12, and also contributes inductive reactance in the starting resonant circuit comprising winding 42, capacitor 17, and winding 18. The lead type circuits of FIGS. 2 and 5 may also exhibit an increased higher frequency harmonic content of the non-linear starting voltage waveform.

If desired, in the circuits of FIGS. 1 and 4 the resonant circuit components 17 and 18 can be connected to the tap on the ballast impedance 16 or 42, such as a tap 23 connected by a dashed line 24, as shown in FIG. 1 instead of to the point 22 at an end of the ballast, so that the impedance value of the ballast inductance in the resonant circuit is less than the value thereof that functions for ballasting the lamps. Thus, this ballast inductance provides two different values for the two different functions.

The invention achieves a relatively simple and inexpensive lamp starting and operating circuit, which improves starting of the lamps in the manner described above, which can also permit eliminating the conventional starting stripes in the lamps, thereby reducing the cost of the lamps, and the invention further reduces operating costs of the lamps, by switching the cathode heating transformer out of the circuit when the lamps are operating, thereby conserving about ten percent of the system input electrical energy, for example a saving of about 5 to 6 watts in a 60 watt system having a pair of 27 watt lamps.

Figure 8:
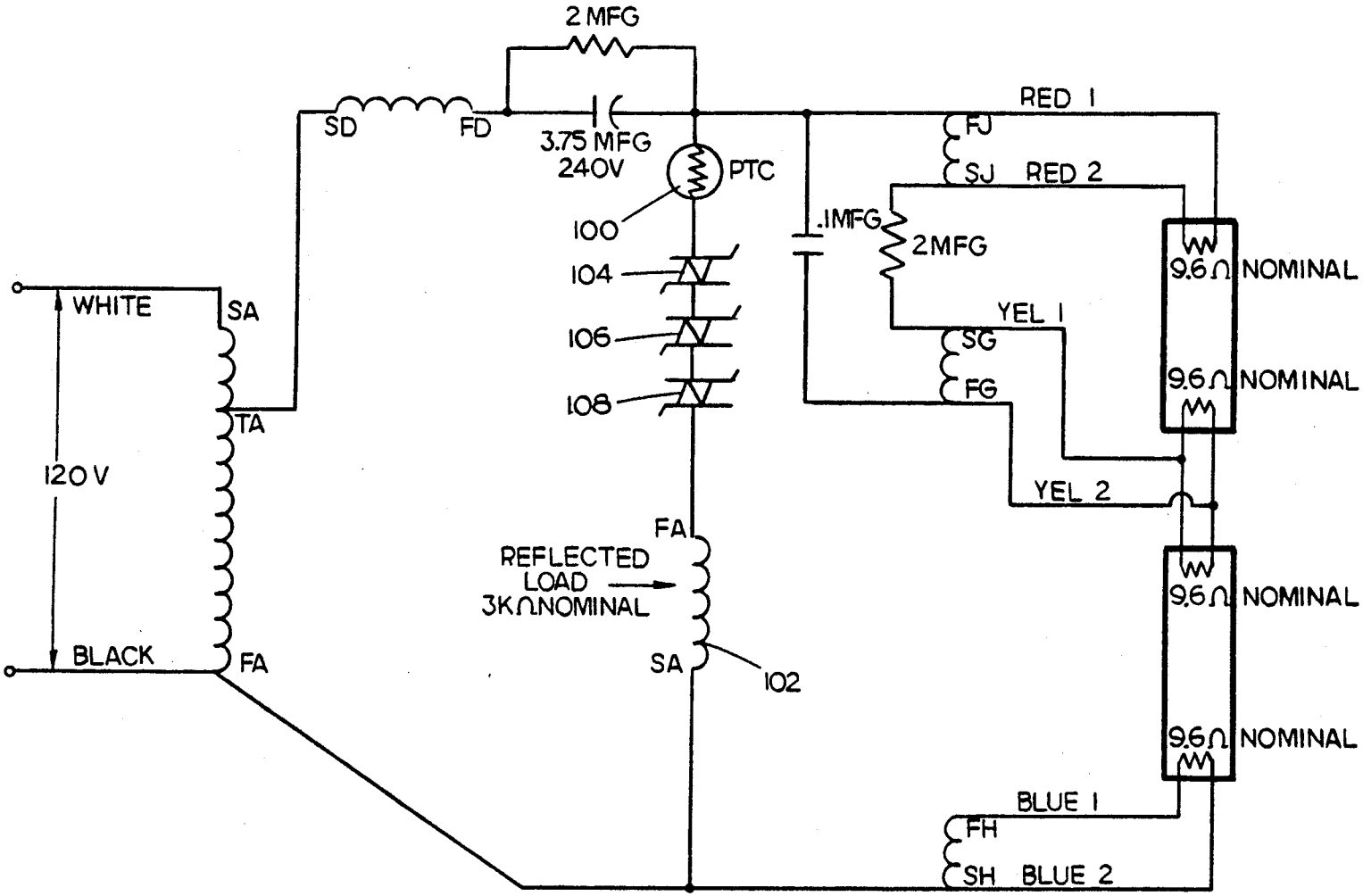
FIG. 8 is an electrical schematic diagram of the improved circuit.

FIG. 8 illustrates the improved circuit of this invention and is essentially the same as that previously described except for two very important modifications thereof. In FIG. 8, a PTC thermistor 100 is utilized in series with the filament transformer primary winding 102. Further, the PTC thermistor is a Nichicon PTC thermistor, part number PDB-49A50-2 (TBD part number 73B140376-6) in the event that one or both of the bulbs in the circuit should rectify, the thermistor 100 will switch from a low impedance to a high impedance to prevent the winding 102 from being subjected to damaging currents and temperatures.

Another very important feature of the improved circuit is the stacking of a plurality of SIDACS 104, 106 and 108 series with the thermistor 100 and the winding 102 as seen in FIG. 8. The SIDACS are preferably a voltage actuated bidirectional diode such as disclosed in U.S. Pat. No. 3,866,088 to Kaneda, which is incorporated herein by reference thereto. This type of switch is conductive when a voltage thereacross is above a certain value, and is open or non-conductive when the voltage thereacross is below a given value. The SIDACS 104, 106 and 108 function identically to the SIDAC 21 in '391 patent except for the stacking of the same in series. During the operation of the SIDACS, it is important that the switching resistance (Rs) be adequate to insure proper switching of the SIDACS. A switching resistance of approximately 3.5 K Ohms is needed for the entire stack of SIDACS 104, 106 and 108 to resolve any possible switching problem.

Thus it can be seen that an improved circuit has been provided which achieves all of its stated objectives.

We claim:

1. A circuit for starting and operating one or more fluorescent lamps from an a-c sine wave electrical power source of given frequency, comprising reactive ballast means connected in series with said power source and said lamps and having a non-linear characteristic for producing a plurality of harmonics of said given frequency, a cathode heating transformer comprising a primary winding and secondary windings for connection to the cathodes of said lamps, a capacitor connected in series with said primary winding, means connecting one or both of said series-connected capacitor and primary winding across said lamps, the combined reactance of said capacitor and said primary winding being at least partially in resonance, in cooperation with inductance of said reactive ballast means, over a frequency range simultaneously encompassing a plurality of said harmonics of the given power source frequency, and a plurality of series connected switches interposed in series with said series-connected capacitor and primary winding, said switches being closed during starting of said lamps to cause said resonance and to cause heating of said cathodes, and said switches being open after starting of and during operation of said lamps.

2. A circuit for starting and operating one or more fluorescent lamps from an a-c sine wave electrical power source of given frequency, comprising reactive ballast means connected in series with said power source and said lamps and having a non-linear characteristic for producing a plurality of harmonics of said given frequency, a cathode heating transformer comprising a primary winding and secondary windings for connection to the cathodes of said lamps, a capacitor connected in series with said primary winding, means connecting one or both of said series-connected capacitor and primary winding across said lamps, the combined reactance of said capacitor and said primary winding being at least partially in resonance, in cooperation with inductance of said reactive ballast means, over a frequency range simultaneously encompassing a plurality of said harmonics of the given power source frequency, and at least one switch interposed in series with said series-connected capacitor and primary winding, said switch being closed during starting of said lamps to cause said resonance and to cause heating of said cathodes, and said switch being open after starting of and during operation of said lamps, and a thermistor interposed in series with said series-connected capacitor and primary winding, said thermistor preventing damage to primary winding in the event of rectification of fluorescent lamp.

3. A circuit as claimed in claim 2, wherein a plurality of said at least one switch is interposed in series with said series-connected capacitor and primary winding.

4. A circuit as claimed in claim 3, in which said at least one switch comprises at least three SIDACS connected in series.

* * * * *